United States Patent [19]

Ivchenkov et al.

[11] Patent Number: 4,808,375

[45] Date of Patent: Feb. 28, 1989

[54] PROCESS FOR PRODUCING ALUMINIUM-SILICON ALLOY WITH CONTENT OF SILICON OF 2–22% BY MASS

[75] Inventors: Vadim P. Ivchenkov; Nikolai A. Kaluzhsky, both of Leningrad; Eduard A. Isidorov; Viktor G. Sirotenko, both of Riga; Viktor S. Shusterov, Leningrad; Gennady A. Pakhomov, Bratsk; Fedor K. Teplyakov, Bratsk; Oleg S. Khromovskikh, Bratsk

[73] Assignees: I. Vsesojuzny Nauchno-Issledovatelsky I Proektny Institut Aljuminievoi, Magnievoi I Elektrodnoi Promyshlennosti, Leningrad; Spetsialnoe Konstruktorskoe Bjuro Magnitnoi Gidrodinamiki Instituta Fiziki Akademii Nauk Latviiskoi SSR, Riga, both of U.S.S.R.

[21] Appl. No.: 25,166

[22] Filed: Mar. 4, 1987

[51] Int. Cl.[4] ..... C22C 1/02

[52] U.S. Cl. ..... 420/548; 75/68 R

[58] Field of Search ..... 420/548; 75/68 R

[56] References Cited

FOREIGN PATENT DOCUMENTS 629429 10/1978 U.S.S.R. .

OTHER PUBLICATIONS

"Metallurgy of Aluminium", by I. A. Troitsky, et al., 1977, Metallurgiya Publishing House, Moscow, p. 367.

"Alloys of Aluminium with Silicon", by G. B. Stroganov, et al., 1977, Metallurgiya Publishing House, Moscow, pp. 208–211.

"High-Productivity Melting of Aluminum Alloys", by A. D. Andreev, et al., 1980, Metallurgiya Publishing House, Moscow, pp. 89–95.

"Melting and Casting of Light Alloys", by M. B. Altman et al., 1969, Metallurgiya Publishing House, Moscow, pp. 663–674.

*Primary Examiner*—R. Dean

*Attorney, Agent, or Firm*—Fleit, Jacobson, Cohn & Price

[57] ABSTRACT

The present invention relates to metallurgy of non-ferrous metals and alloys and, more particularly, to a process for producing an aluminium-silicon alloy with a content of silicon of 2 to 22% by mass. The process comprises charging crystalline silicon onto the sole of a reverberatory furnace so that the charged crystalline silicon has a cone shape, casting liquid aluminium into the furnace bath at 780°–820° C. and agitation of the resulting aluminium-silicon melt by means of a shaped jet of the same melt; the melt jet is directed into the base of the cone of the charged crystalline silicon at a speed of the jet along the axis thereof of from 0.5 to 0.8 m/s; simultaneously with the beginning of agitation the melt temperature in the furnace bath is lowered to 670°–750° C. and agitation of the melt is effected at this temperature. The alloy can be used in the automobile industry, tractor manufacture in the production of consumer goods.

3 Claims, No Drawings

PROCESS FOR PRODUCING ALUMINIUM-SILICON ALLOY WITH CONTENT OF SILICON OF 2-22% BY MASS

FIELD OF THE INVENTION

The present invention relates to the art of metallurgy of non-ferrous metals and alloys and, more specifically, to processes for producing an aluminium-silicon alloy with a content of silicon of 2-22% by mass. This alloy is useful for making shaped foundry articles for the automobile industry, tractor manufacture and in the manufacture of consumer goods.

BACKGROUND OF THE INVENTION

Known in the art is a process for producing an aluminium-silicon alloy with a content of silicon of 2-22% by mass which comprises charging crystalline silicon onto a sole of a reverberatory furnace, the charged crystalline silicon has a tapered form, casting liquid aluminium into the bath of the reverberatory furnace at a temperature of 780° to 820° C. and a discontinuous manual agitation of the resulting aluminium-silicon melt (cf. I. A. Troitsky, V. A. Zheleznov, "Metallurgy of Aluminium", published 1977, "Metallurgiya" Publishing House, Moscow, p. 367; G. B. Stroganov, V. A. Rotenberg, G. B. Gershman "Alloys of Aluminium with Silicon", 1977, "Metallurgiya" Publishing House, Moscow, p. 208-211, see especially p. 210).

Also known in the art is a process for producing an aluminium-silicon alloy with a content of silicon of 2-22% which is effected in a manner similar to that of the process described hereinabove, but the agitation of the resulting aluminium-silicon melt is effected by a shaped jet of the same melt directed through a geometric center of the furnace bath into the upper part of the cone of the charged crystalline silicon (cf. USSR Inventor's Certificate No. 629429, Int. Cl.$^2$ F 27 B 17/00, Bulletin "Discoveries, Inventions, industrial Designs, Trademarks" No. 39, published Oct. 25, 1978).

A disadvantage of the prior art processes resides in that the process for the production of an aluminium-silicon alloy is conducted at elevated temperatures (780°-820° C.) which results in an increased content of hydrogen and aluminium oxide in the final alloy. This, in turn, impairs quality of the resulting alloy and in increased irrevocable losses of the charge materials.

The use of the above-mentioned techniques of agitation of the aluminium-silicon melt in the prior art processes causes floating of lump-like crystalline silicon to the surface and, hence, its oxidation and losses with slags.

SUMMARY OF THE INVENTION

It is an object of the present invention to provide such a process for producing an aluminium-silicon alloy with a content of silicon of 2-22% by mass which would make it possible to produce an alloy with a lowered content of hydrogen and aluminium oxide and, thereby, to improve quality of the alloy and considerably reduce irrevocable losses of the charge materials.

It is another object of the present invention to provide such a process which would make it possible to eliminate floating of lump-like crystalline silicon to the melt surface and, thereby, to avoid its oxidation and losses with slags.

These and other objects of the present invention are accomplished by the provision of a process for producing an aluminium-silicon alloy with a content of silicon of 2-22% by mass comprising charging crystalline silicon onto the sole of a reverberatory furnace, the charged crystalline silicon having the cone shape, casting of liquid aluminium into the bath of the reverberatory furnace at a temperature of from 780° to 820° C. and agitation of the resulting aluminium-silicon melt by a shaped jet of the same melt, wherein according to the present invention the melt jet is directed to the bottom of the cone of the charged crystalline silicon; the speed of the melt jet along its axis is maintained equal to 0.5-0.8 m/s; simultaneously with the beginning of agitation the melt temperature in the furnace bath is lowered to 670°-750° C. and the melt agitation is effected at this temperature.

By directing the melt jet into the base of the cone of charged crystalline silicon at the above-mentioned speed (0.5-0.8 m/s along the melt axis) conditions are provided for a gradual dissolution of silicon beginning with the cone base. This contributes to a progressive subsiding of the cone and, consequently, elimination of floating of lump-like crystalline silicon to the melt surface, its oxidation and losses with slags.

The provision of the above-described agitation conditions makes it possible to lower the process temperature (temperature in the furnace bath) to 670°-750° C. due to improved pattern of heat- and mass-transfer within the melt bulk, thus enabling reduction of the content of hydrogen and aluminium oxide in the alloy and, thereby, improvement of the metal quality and a considerable decrease of irrevocable losses of the charge materials. Furthermore, carrying-out of the process at lowered temperatures results in a considerable reduction of power consumption.

The present invention provides casting of liquid aluminium into the bath of a reverberatory furnace at a temperature within the range of 780° to 820° C. This casting temperature is selected due to a specific character of operation of the reverberatory furnace and conditions of the process for producing the alloy in this furnace.

As it has been already mentioned hereinabove, in the process according to the present invention the melt jet is directed to the base of the cone of charged crystalline silicone at the speed (along the jet axis) equal to 0.5-0.8 m/s. It is inadvisable to supply the melt jet at a speed along its axis of less than 0.5 m/s, since in doing so the movement of the melt in the bath comes into a calm laminar flow, whereby the effectiveness of agitation is reduced (i.e., the efficiency of heat- and mass-transfer processes within the melt bulk in the furnace bath is lowered). It is neither expedient to supply the melt jet at a speed along its axis of more than 0.8 m/s, since it is economically inefficient because no improvement of the process parameters takes place upon a further increase of the supply rate.

In the process according to the present invention, simultaneously with the beginning of the melt agitation, the melt temperature in the furnace bath is lowered to 670°-750° C. and the melt agitation is effected at this temperature. It is not advisable to carry out the process at a temperature below 670° C., since this results in a higher viscosity of the melt, lesser efficiency of agitation and, hence, in an extended time of silicon dissolution. Carrying out the process at a temperature above 750° C. results in an undesirable increase of hydrogen solubility in the alloy and greater losses of aluminium due to oxidation thereof.

DETAILED DESCRIPTION OF THE INVENTION

The process for producing an aluminium-silicon alloy with a content of silicon of 2–22% by mass according to the present invention is effected in the following manner.

Onto the sole of a reverberatory furnace the required amount of crystalline silicon is charged through an opening in the furnace crown, the charged crystalline silicon has a cone shape. Then the predetermined amount of liquid aluminium is charged into the furnace bath at a temperature of 780°–820° C. Then the resulting aluminium-silicon melt is stirred by means of a shaped jet of the same melt. The melt jet can be formed, for example, using centrifugal pumps available from "Carborundum", a US company, gas-dynamic pumps, electromagnetic agitating means (cf. A. D. Andreev, V. B. Gogin, G. S. Makarov "High-Productivity Melting of Aluminium Alloys" 1980, "Metallurgiya" Publishing House, Moscow, pp. 89–95). The shaped jet of the melt is directed into the base of the cone of the charged crystalline silicon so that the speed of the melt jet along the axis thereof is kept within the range of from 0.5–0.8 m/s. Simultaneously with the beginning of the agitation, the melt temperature in the furnace bath is lowered to 670°–750° C. and the agitation of the melt is conducted at this temperature. The temperature reduction to the above-specified values can be effected by disconnecting the heat source or by ensuring a forced heat removal with the view to further use it in other processes.

The readiness of the alloy is determined by the results of express analysis for the content of the main components of the alloy and content of impurities, whereafter the final alloy is cast into moulds.

For a better understanding of the present invention some specific examples are given hereinbelow by way of illustration of its particular embodiments.

EXAMPLE 1

Onto the sole of a 25,000 kg reverberatory furnace (as calculated for a liquid metal) 2,950 kg of crystalline silicon are charged through an opening in the furnace crown so that the charged silicon is shaped on the sole as a cone. Then 22,050 kg of liquid aluminium at the temperature of 820° C. are cast into the furnace bath. The calculated content of silicon in the alloy is 11.7% by mass. Then the resulting aluminium-silicon melt is agitated by means of a shaped jet of the same melt. The melt jet is shaped using an electromagnetic agitating device and directed into the base of the charged crystalline silicon cone at the speed of 0.8 m/s along its axis. Simultaneously with the beginning of the agitation the melt temperature in the furnace bath is lowered to 700° C. by disconnecting the heat source and the melt is agitated at the above-specified temperature.

The melt readiness is determined by the result of an express-analysis for the content of the main components of the alloy and content of impurities, whereafter the final alloy with the content of silicon of 11.4% by mass is cast into an ingot mould.

Table 1 shows examples of realization of the process according to the present invention.

TABLE 1

| No 1 | Example No. 2 | Content of silicon in the alloy, % by mass 3 | Amount of liquid aluminium cast into the bath, kg 4 | Amount of charged crystaline silicon, kg 5 | Temperature of casting of liquid aluminium, °C. 6 | Speed of melt jet along its axis m/s 7 | Temperature of the melt agitation, °C. 8 |
|---|---|---|---|---|---|---|---|
| 1 | 2 | 2 | 24490 | 510 | (a) 780<br>(σ) 800<br>(B) 820 | 0,5 | 670 |
| 2 | 3 | 11 | 22112 | 2888 | (a) 780<br>(σ) 800<br>(B) 820 | 0,5 | 670 |
| 3 | 4 | 13 | 21587 | 3413 | (a) 780<br>(σ) 800<br>(B) 820 | 0,5 | 670 |
| 4 | 5 | 22 | 19465 | 5535 | (a) 780<br>(σ) 800<br>(B) 820 | 0,5 | 670 |
| 5 | 6 | 2 | 24490 | 510 | 800 | (a) 0,7<br>(σ) 0,8 | 670 |
| 6 | 7 | 11 | 22112 | 2888 | 800 | (a) 0,7<br>(σ) 0,8 | 670 |
| 7 | 8 | 13 | 21587 | 3413 | 800 | (a) 0,7<br>(σ) 0,8 | 670 |
| 8 | 9 | 22 | 19465 | 5535 | 800 | (a) 0,7<br>(σ) 0,8 | 670 |
| 9 | 10 | 2 | 24490 | 510 | 800 | 0,7 | (a) 700<br>(σ) 750 |
| 10 | 11 | 11 | 22112 | 2888 | 800 | 0,7 | (a) 700<br>(σ) 750 |
| 11 | 12 | 13 | 21587 | 3413 | 800 | 0,7 | (a) 700<br>(σ) 750 |
| 12 | 13 | 22 | 19465 | 5535 | 800 | 0,7 | (a) 700<br>(σ) 750 |

Efficiency of the process according to the present invention is assessed by the results of analysis of the alloy for the content of hydrogen and aluminium oxide, as well as by the composition of slags. For the purpose of comparison, efficiency of the prior art processes is also assessed using the same parameters.

The content of hydrogen and aluminium oxide in the alloy is determined using the procedure described in the book by M. B. Altman, A. A. Lebedev, M. V. Chukhrov "Melting and Casting of Light Alloys", 1969, "Metallurgiya" Publishing House, Moscow, pp. 663–674. Analysis of the slag compositions is effected by conventional chemical and analytical methods.

Table 2 hereinbelow shows the efficiency characteristics of the process according to the present invention and prior art processes determined using the above-mentioned procedures.

TABLE 2

| No. 1 | Example No. 2 | Content of hydrogen in the alloy, $cm^3$/100 g of the alloy 3 |
|---|---|---|
| 1 | 1 | 0.191 |
| 2 | 2 a | 0.190 |
| | σ | 0.193 |
| | B | 0.192 |
| 3 | 3 a | 0.188 |
| | σ | 0.190 |
| | B | 0.192 |
| 4 | 4 a | 0.194 |
| | σ | 0.191 |
| | B | 0.191 |
| 5 | 5 a | 0.197 |
| | σ | 0.200 |
| | B | 0.195 |
| 6 | 6 a | 0.192 |
| | σ | 0.193 |
| 7 | 7 a | 0.192 |
| | σ | 0.193 |
| 8 | 8 a | 0.194 |
| | σ | 0.191 |
| 9 | 9 a | 0.200 |
| | σ | 0.195 |
| 10 | 10 a | 0.196 |
| | σ | 0.195 |
| 11 | 11 a | 0.200 |
| | σ | 0.196 |
| 12 | 12 a | 0.200 |
| | σ | 0.197 |
| 13 | 13 a | 0.200 |
| | σ | 0.200 |
| | Prior art process (A) | 0.257 |
| | Prior art process (B) | 0.244 |

| No. 1 | Content of aluminium oxide in the alloy: as disperse inclusion (by chemical analysis), % by mass 4 | Content of aluminium oxide in the alloy: as large inclusions and scabs (by process test), $mm^2/sm^2$ 5 | Total content of aluminium and silicon in slags, % by mass 6 |
|---|---|---|---|
| 1 | 0.017 | 0.340 | 51.06 |
| 2 a | 0.018 | 0.330 | 49.88 |
| σ | 0.019 | 0.350 | 50.56 |
| B | 0.018 | 0.360 | 51.09 |
| 3 a | 0.015 | 0.330 | 51.06 |
| σ | 0.017 | 0.330 | 51.06 |
| B | 0.017 | 0.350 | 51.06 |
| 4 a | 0.016 | 0.340 | 51.06 |
| σ | 0.017 | 0.340 | 51.06 |
| B | 0.017 | 0.340 | 51.06 |
| 5 a | 0.022 | 0.365 | 53.06 |
| σ | 0.023 | 0.375 | 54.18 |
| B | 0.020 | 0.346 | 52.30 |
| 6 a | 0.018 | 0.335 | 50.10 |
| σ | 0.019 | 0.353 | 50.50 |
| 7 a | 0.017 | 0.330 | 51.06 |
| σ | 0.018 | 0.350 | 51.06 |
| 8 a | 0.016 | 0.340 | 51.06 |
| σ | 0.017 | 0.340 | 51.06 |
| 9 a | 0.021 | 0.375 | 54.16 |
| σ | 0.020 | 0.345 | 52.19 |
| 10 a | 0.019 | 0.350 | 50.37 |
| σ | 0.019 | 0.352 | 51.60 |
| 11 a | 0.021 | 0.370 | 53.26 |
| σ | 0.019 | 0.360 | 53.26 |
| 12 a | 0.019 | 0.370 | 53.26 |
| σ | 0.020 | 0.380 | 53.26 |
| 13 a | 0.022 | 0.370 | 53.55 |
| σ | 0.020 | 0.367 | 54.26 |
| | 0.039 | 0.516 | 70.12 |
| | 0.036 | 0.488 | 68.34 |

Note:
(A) - prior art process disclosed in the above mentioned books: I. A. Troitsky, V. A. Zheleznov "Metallurgy of Aluminium"; G. B. Stroganov, V. A. Rotenberg, G. B. Gershman "Alloys of Aluminium and Silicon"
(B) - prior art process as described in the USSR Inventor's Certificate No. 629429.

Comparative analysis of the data shown in Table 2 shows that the use of the process according to the present invention makes it possible to reduce the content of hydrogen in the final alloy by 22% on the average, that of aluminium oxide in the form of disperse inclusions—by 50% on the average, the content of aluminium oxide in the form of large-size inclusions and scabs—by 70% on the average. Furthermore, the total content of aluminium and silicon in slags is reduced by 25% on the average.

What is claimed is:

1. A process for producing an aluminum-silicon alloy with a content of silicon of 2–22% by mass comprising charging crystalline silicon onto the sole of a reverberatory furnace, the charged crystalline silicon having a cone shape; casting liquid aluminium onto the sole of said reverberatory furnace to form a molten bath with the silicon at a temperature of from 780° to 820° C.; agitating the resulting aluminum-silicon melt by a shaped jet of the same melt, said melt jet being directed into the base of the cone of the charged crystalline silicon; and casting the resultant melt into a mold to produce an aluminum-silicon alloy in a solid state.

2. A process according to claim 1, wherein the melt jet speed along its axis is maintained within the range of from 0.5 to 0.8 m/s.

3. A process according to claim 1, wherein, simultaneously with the beginning of agitation, the melt temperature in the furnace bath is lowered to 670°–750° C. and the melt agitation is effected at this temperature.

* * * * *